United States Patent [19]

Speer

[11] Patent Number: 4,790,039

[45] Date of Patent: Dec. 13, 1988

[54] TECHNIQUE FOR SANITIZING TOILET SEATS

[75] Inventor: Lane L. Speer, Corpus Christi, Tex.

[73] Assignee: W. W. Scarborough, Corpus Christi, Tex.

[21] Appl. No.: 118,449

[22] Filed: Nov. 9, 1987

[51] Int. Cl.[4] ..... A47K 13/00

[52] U.S. Cl. ..... 4/233; 4/229; 4/230

[58] Field of Search ..... 4/233, 230, 231, 228, 4/229

[56] References Cited

U.S. PATENT DOCUMENTS

| | | | |
|---|---|---|---|
| 919,512 | 4/1909 | Young | 4/229 |
| 1,712,816 | 5/1929 | Elliott | 4/229 |
| 2,320,156 | 5/1943 | Perlmutter | 4/233 |
| 2,706,767 | 4/1955 | Packchanian | 219/529 |
| 2,773,167 | 12/1956 | Arbaugh | 219/537 |
| 2,795,799 | 6/1957 | Dickerman | 219/537 |
| 3,088,125 | 5/1963 | Southwood | 4/222 |
| 3,143,745 | 8/1964 | Price | 4/222 |
| 3,371,355 | 3/1968 | Wipf | 4/222 |
| 3,605,133 | 9/1971 | Quercia et al. | 4/231 |
| 3,801,999 | 4/1979 | McNally | 4/229 |
| 4,063,316 | 12/1977 | Hunninghaus | 4/233 |
| 4,193,144 | 3/1980 | McNally | 4/229 |
| 4,242,764 | 1/1981 | Fukuda | 4/233 |
| 4,625,342 | 12/1986 | Gangnath et al. | 4/228 |
| 4,670,916 | 6/1987 | Bloom | 4/231 |

*Primary Examiner*—Henry K. Artis
*Attorney, Agent, or Firm*—G. Turner Moller

[57] ABSTRACT

A portable toilet is equipped with a toilet seat having a cover thereon which is capable of delivering a charge of sanitizing and/or deodorizing fluid onto the upper surface thereof. A source of sanitizing and/or deodorizing fluid is periodically energized.

4 Claims, 1 Drawing Sheet

TECHNIQUE FOR SANITIZING TOILET SEATS

This invention relates to a technique for sanitizing toilet seats, particularly in portable toilets of the type housed in a small building which is transported from location to location.

It is known in the prior art that toilet seats are often unhygienic and public toilets in particular are often objectionable to fastidious people. In response to this perception, proposals have been made to provide sanitizing or deodorizing mechanisms in conjunction with toilet seats, particularly toilet seats used in public places, such as airport terminals, theatres and the like where large groups of the public congregate. Disclosures of this type are found in U.S. Pat. Nos. 919,512; 2,320,156; 2,706,767; 2,773,167; 2,795,799; 3,088,125; 3,143,745; 3,371,355; 3,801,999; and 4,063,316. For reasons that are not wholly understood, these devices have not reached the marketplace and, in common experience, are unknown. It is believed that the absence of these devices is due to a common cause—those who have to bear the additional cost have no interest or incentive to do so.

So far as can be determined, all of the above disclosures relate to permanent toilet installations of the kind that are typical in airline terminals, theatres and the like. The need perceived in the present invention is slightly different and in many ways, much more acute. A small, but healthy, industry has grown up in this country providing what is generically known as portable toilets—and which are marketed under the such charming names as Port-A-John, Port-A-Can, Johnny-on-the-Spot and the like. Portable toilets are typically found at outdoor sporting events held in temporary stadiums, parades, construction sites, and the like. Despite conscientious attempts by the operator, portable toilets are notoriously unhygienic and smelly. Only those in dire need open the door of the normal portable toilet. It is this particular market segment that this invention is most nearly related.

Just as there are two sides to every story, there are two sides to the problem of hygiene in portable toilets. Just as they are objectionable to patrons, they are objectionable to clean up. Particularly in the case of portable toilets, users are not particularly finicky about cleaning up after themselves. Surely no one would do at home what is commonly found in portable toilets. It is for this reason that the interiors of portable toilets are constructed of exteriorly slick fiberglass with smooth curved corners rather than sharp rectangular corners. In the environment of portable toilets, the idea of providing a toilet seat with a multiplicity of small perforations is absurd since it is known to a moral certainty what will ultimately accumulate in the small openings. Without being too graphic, it will be necessary to boil the seats to clean the small openings and remove the smell. Can one imagine boiling toilet seats?

The device of this invention comprises a plastic sleeve or seat cover that slips over or sets on top of a toilet seat of essentially the same shape. For conventionally horseshoe shaped toilet seats, the seat cover is likewise generally horseshoe shaped. The plastic seat cover includes a multiplicity of upwardly facing openings therein. Adjacent the rear of the seat cover, in the area of the seat hinge, a conduit connects to a source of deodorizing or sanitizing fluid, either gaseous or aerosol. Periodically, either on command of the user or a timer, or in response to a flush mechanism, a charge of deodorizing or sanitizing fluid is delivered from the source, through the conduit and into the plastic seat cover. The material escapes from the seat cover through the upwardly facing openings thereby sanitizing or deodorizing the toilet seat and making it less objectionable to fastidious persons.

After the portable toilet is picked up and returned to the operator, the chambers are emptied and the interior of the enclosure is cleaned up. It is a simple matter to remove the plastic sleeve or seat cover from the seat and throw it away. The seat will necessarily be clean since it has been enclosed or covered by the sleeve. One of the beauties of this invention is that the cost is borne by the operator who has an incentive to use it because it is much easier to sell clean, disinfected portable toilets as compared to those presently in vogue.

It is accordingly an object of this invention to provide a technique for disinfecting toilet seats which has particular application to portable toilets.

Other objects and advantages of this invention will become more fully apparent as this description proceeds, reference being made to the accompanying drawing and appended claims.

DETAILED DESCRIPTION OF THE PREFERRED EMBODIMENT

Figure 1:
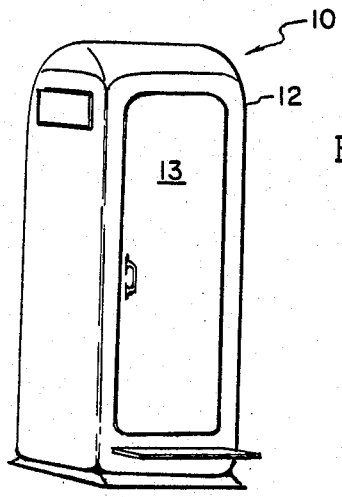
FIG. 1 is an exterior view of a typical portable toilet enclosure.
Figure 2:
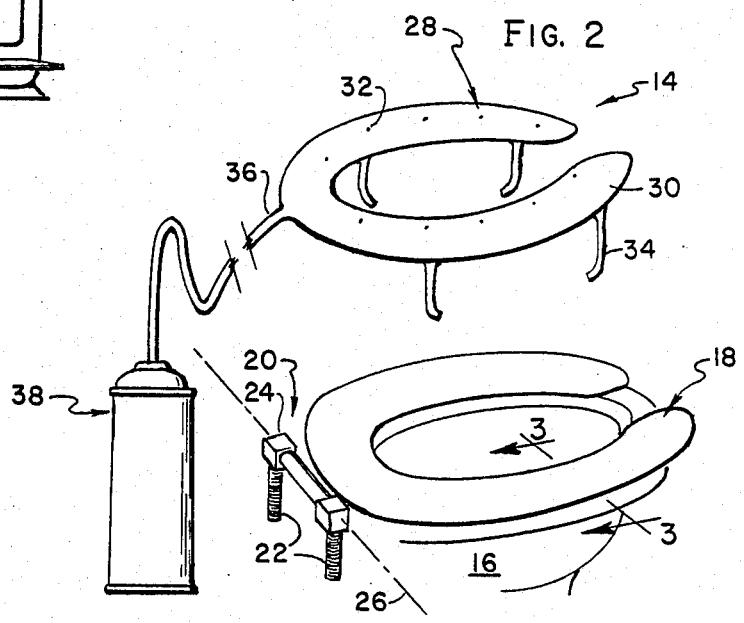
FIG. 2 is an exploded diagram of a plastic seat cover of this invention in relation to the seat with which it is used.
Figure 3:
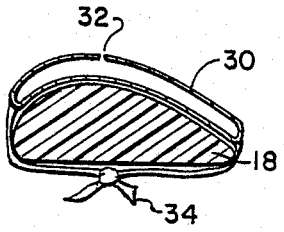
FIG. 3 is an enlarged cross-sectional view of the seat cover and seat of FIG. 2, taken substantially along line 3—3 thereof, as viewed in the direction indicated by the arrows.

Referring to the drawings, there is illustrated a portable toilet 10 including a small building or enclosure 12 having a door 13 providing access to a toilet 14 inside the enclosure 12. The toilet 14 includes a bowl 16 and a seat 18 pivotally connected thereto by a hinge mechanism 20 of any conventional design. Fasteners 22 are typically provided for attaching the seat 18 to the bowl 16.

The hinge 20 includes a hinge housing 24 which obscures a bearing mechanism (not shown) mounting the seat 18 for rotation about an axis 26 between its conventional up and down positions. The seat 18 may be of any suitable shape and is illustrated as being of a conventional horseshoe shaped type. Typically, the seat 18 is molded from fiberglass to provide a slick, easy to clean exterior surface. As is evident to those skilled in the art, the portable toilet 10, as heretofore described, is of conventional design.

To sanitize and/or deodorize the toilet seat 18, the sleeve or seat cover 28 of this invention is provided. The seat cover 28 preferably includes an elongate curved tubular body 30 of generally the same shape as the seat 18. The body 30 may be made of an organic polymeric material which is gas permeable to allow the exit of a sanitizing or deodorizing gas. Preferably, the body 30 includes a series of upwardly facing perforations or openings 32 which allow the sanitizing or deodorizing fluid to escape.

The seat cover 28 may be temporarily secured to the seat 18 in any suitable fashon, as by the use of an adhesive or the like. Conveniently, however, the cover 28 includes a series of straps 34 which are used to tie the cover 28 onto the seat 18. The seat cover 28 also includes a conduit 36 adjacent the rear thereof which connects to a source 38, such as an aerosol can, of sanitizing or deodorizing spray. It will be seen that actuation of the spray source 38 delivers a charge of deodorizing or sanitizing spray into the conduit 36 and seat cover 28 which exits through the openings 32. It will accordingly be seen that the seat cover 28 and the seat 18 are less objectionable to patrons.

The source 38 is periodically energized in any suitable manner, as by user command, by the operation of a flush mechanism, in response to raising and lowering the seat 18, in response to every other opening movement of the door 13, or the like.

It will be seen that the cover 28 provides a simple, inexpensive and effective means for deodorizing and/or sanitizing the toilet seat 18. It will also be seen that it may act to give patrons a sense of security.

Although the invention has been described in its preferred form with a certain degree of particularity, it is understood that the present disclosure is only by way of example and that numerous changes in the details of construction and in the combination and arrangement of parts may be resorted to without departing from the spirit and scope of the invention as hereinafter claimed.

I claim:

1. A toilet having a throw-away plastic curved seat including means affixing the seat to the toilet; and a cover of like configuration on the seat comprising a hollow member having an upper seating surface and capable of transporting a charge of hygienic spray, the hollow member being attached to the seat and providing a lower surface in contact with the seat and an upper spray permeable surface, a source of pressurized hygienic spray and a conduit interconnecting the source and the hollow member whereby the pressurized hygienic spray is delivered to the upper seating surface of said throw-away cover.

2. The toilet of claim 1 wherein the cover includes a plurality of straps connected to and extending away from the hollow member and tieing the member to the seat.

3. The toilet of claim 1 wherein the hollow member provides a series of openings on the upper surface to allow exit of the hygienic spray.

4. The toilet of claim 1 wherein the conduit connects to the hollow member adjacent the means affixing the seat to the toilet.

* * * * *